United States Patent [19]

Wilder

[11] 4,312,405

[45] Jan. 26, 1982

[54] CEMENTING PROCEDURE FOR CASING

[75] Inventor: Lawrence B. Wilder, Tulsa, Okla.

[73] Assignee: Standard Oil Company (Indiana), Chicago, Ill.

[21] Appl. No.: 165,523

[22] Filed: Jul. 3, 1980

[51] Int. Cl.[3] ..... E21B 33/14; E21B 33/16

[52] U.S. Cl. ..... 166/285; 166/291

[58] Field of Search ..... 166/285, 286, 290, 242, 166/177

[56] References Cited

U.S. PATENT DOCUMENTS

| | | | |
|---|---|---|---|
| 2,072,982 | 3/1937 | Dale | 166/286 |
| 2,609,881 | 9/1952 | Warren | 166/285 |
| 2,678,082 | 4/1954 | Hall | 166/285 |
| 2,738,011 | 3/1956 | Mabry | 166/290 X |
| 2,876,844 | 3/1959 | Warner | 166/290 X |
| 3,205,945 | 9/1965 | Holt | 166/286 |
| 3,557,875 | 1/1971 | Solum et al. | 166/286 |
| 3,976,139 | 8/1976 | Wilder | 166/286 |
| 4,093,028 | 6/1978 | Brandon | 166/286 X |

*Primary Examiner*—James A. Leppink
*Assistant Examiner*—George A. Suchfield
*Attorney, Agent, or Firm*—Scott H. Brown; Fred E. Hook

[57] ABSTRACT

This invention relates to improved methods for cementing a casing in a wellbore to prevent poor cement jobs by twisting the casing string under tension or compression while circulating the cement in the annulus between the casing and wellbore in a conventional manner. A J-slot is positioned on the lower portion of the casing. The lower end of the tubing string is provided with a turning and stressing tool and a lug, the lug being engagable with the J-slot. The lug and J-slot are engaged and the lower portion of the casing is caused to twist and stress while cement is being circulated in the wellbore/casing annulus.

4 Claims, 4 Drawing Figures

CEMENTING PROCEDURE FOR CASING

FIELD OF THE INVENTION

This invention relates to a method and apparatus for cementing a casing in a wellbore. In particular, it concerns a method and apparatus whereby a lower section of the casing is oscillated and reciprocated while cement is being circulated in the annulus between the casing and the wellbore using conventional optimum methods.

SETTING OF THE INVENTION

In the search for oil and gas, boreholes are drilled deep into the earth. These holes are lined with casing, which is usually heavy steel pipe, and cement grout is forced into the annulus between the outer wall of the casing and the borehole wall. It is important to insure that the cement completely surround the pipe so as to preclude flow between the borehole and the casing. In conventionally cementing a casing string in a wellbore, current good practice requires that the entire casing string be reciprocated and rotated during the placing or circulation of the cement in the annulus. Pipe movement is essential for scratchers to be effective in breaking up the mudcake adhering to the formation and also to insure that the cement is allowed to completely surround the casing.

However, pipe movement is not universally practiced due to the risk involved since the pipe may become stuck above the desired landing depths during the reciprocation of the casing. Further, when cementing long strings of casing, especially in deviated holes, it is extremely difficult to actually reciprocate or rotate the entire pipe string from the top due to friction and/or hang-up on ledges without exceeding the tensile strength of the casing body and/or the casing joint.

The present invention permits conventional placing of cement while oscillating the lower portion of the string of casing with axial and/or angular movement to break up the mud cake adhering to the formation and outer wall of the casing string and thus cause the cement to circulate and completely surround the casing.

RELEVANT PUBLICATION

U.S. Pat. No. 3,976,139, Lawrence B. Wilder, which issued Aug. 24, 1976, and entitled "Anchoring for Tensioning Casing in Thermal Wells" discloses a method whereby the casing string is anchored to the formation wellbore wall after the cement has been circulated. Such an arrangement does not permit the casing to be placed under tension and rotated in the same operation. Still further, the patent does not allow the casing string to be rotated while being maintained under compression.

The instant invention described herein has a different anchoring system and permits cement to be placed in the casing annulus in the conventional manner while twisting and/or axially moving a lower portion of the casing string. The compression and rotation of the lower end of the casing with a drilling or tubing string causes a substantial movement, e.g. spiral buckling, of the lower end of the casing. This buckling is especially beneficial because the casing moves away from its preferred position on the low side of the hole and gives mud removal wash fluids and cement ample time and space to completely surround the casing.

SUMMARY OF THE INVENTION

By this invention, a method is disclosed for cementing a casing in a wellbore including suspending the casing in the wellbore, suspending a second smaller tubular string within the casing, attaching the lower end of the smaller tubing to the lower portion of the casing and the tubing while placing cement in at least a part of the annulus between the lower portion of the casing and the wall of the wellbore. Movement of the tubing includes oscillating angularly and reciprocating axially.

BRIEF DESCRIPTION OF THE DRAWINGS

A better understanding of the invention and various modifications and objects thereof can be made from the following description taken in conjunction with the drawings in which.

DETAILED DESCRIPTION OF THE INVENTION

Figure 1:
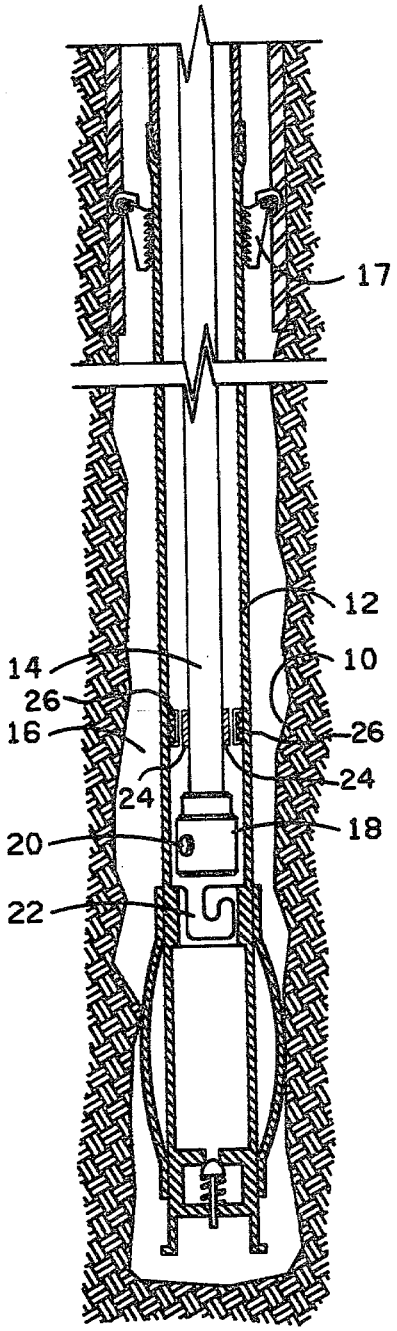
FIG. 1 is an enlarged cut-away view mostly in section showing one embodiment of the reciprocating device.

With reference now to FIG. 1 in preparation for production of oil or gas from the subterranean formation, a borehole 10 is drilled into the formation, a casing 12 is lowered into the borehole 10 to its desired position, and a tubing string 14 is lowered into the casing 12. Between the casing 12 and the borehole 10 is an annular space 16 which is to be filled with cement. Preferably, the upper end of casing 12 is maintained in an essentially stationary fixed position during the method of this invention by *slips* 17.

The lower end of the tubing string 14 is provided with a reciprocating and turning tool 18 which has a connecting lug 20. The lower portion of the interior wall of the casing string 12 is provided with a J-slot 22 which is engageable with tool 18 and lug 20 of the tubing string 14. The tubing string 14 with tool 18 is then positioned by a surface operator to engage the J-slot 22 of casing 12 and the lug 20 and J-slot 22 are engaged.

The lower portion of the tubing string 14 is provided with a packer 24 which is activated and expands in the annulus between the tubing 14 and the casing 12 to engage packer seat 26 which is provided on the wall of casing 12.

Figure 2:
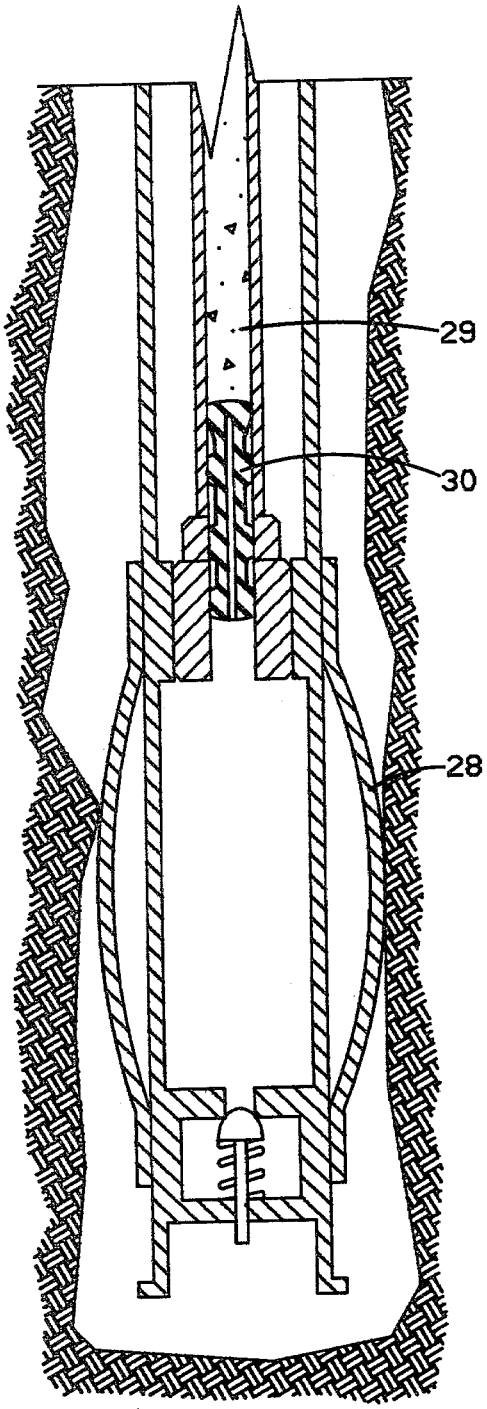
FIG. 2 illustrates a plug in the tubing string.
Figure 3:
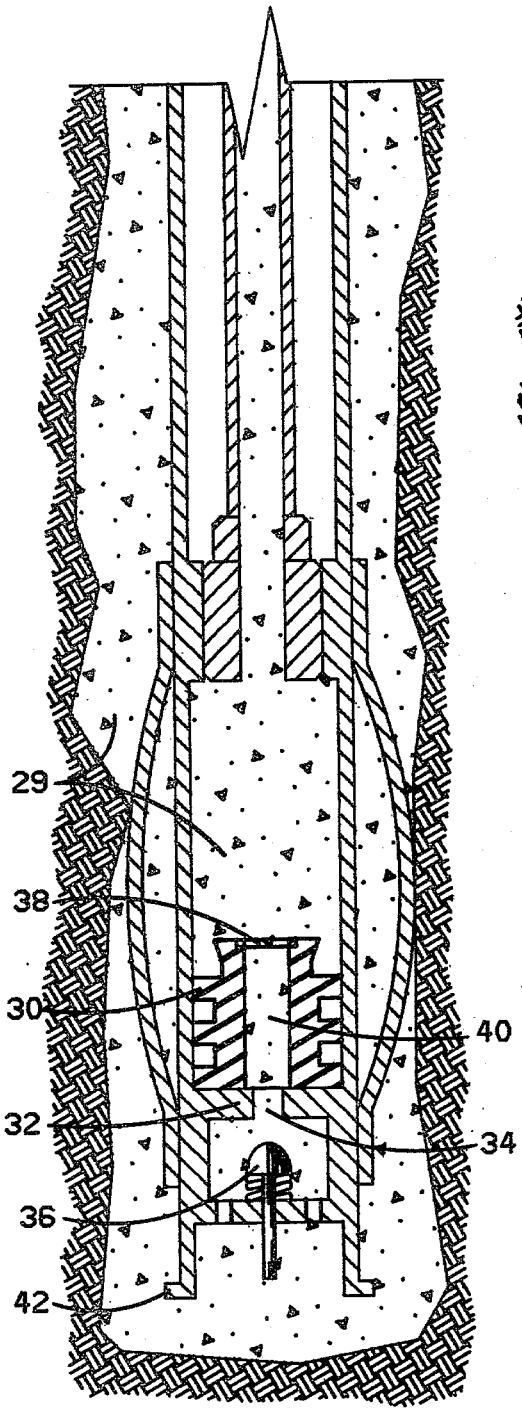
FIG. 3 is a sequence to FIG. 2 and shows the plug in the casing.

With reference to FIG. 2, the lower portion of the casing 12 may be optionally provided with a centralizer 28. As illustrated in FIG. 2, bottom plug 30 is placed in the tubing string 14 just ahead of a cement slurry 29 and wipes the interior of the tubing string 14 clean with its wipers as it moves down tubing string 14. The cement slurry 29 is then pumped down the interior of tubing 14. The packer 24 and a packer seat 26 prevents cement from moving up the annulus between the casing 12 and the tubing string 16. Upon reaching the end of tubing string 14, the plug 30 moves into the casing 12, and expands to fill the larger diameter of the casing 12 as illustrated in FIG. 3. Plug 30 comes to rest on float collar 32 which is provided with a passage 34 therethrough and a check valve 36.

The pressure on the cement slurry is then sufficiently increased to rupture rubber diaphragm 38 at the top of bottom plug 30 and this allows the cement slurry 29 to proceed down through passage 40 of the plug 30 through float collar 32 and past the bottom end 42 of the casing 12 and up the annular space 16.

During the circulation of the cement up the annulus 16, the tubing string 14 is oscillated and/or reciprocated at the surface, thus causing the lower portion of casing 12 to be moved in a similar manner. The casing 12 may be compressed or tensioned, depending upon the position of lug-20 in the J-slot 22 used on the casing 12. This oscillatory twisting and axially reciprocating procedure continues until good engineering practice dictates that the cement has been adequately circulated in the annular space 16. Preferably the stressing/twisting step ceases prior to the setting of the cement. The lower portion casing 12 under such movement is caused to spiral/buckle thereby breaking up mudcake attached to the formation wall and the casing 12 and allowing the cement to circulate freely and to surround completely the casing 12.

Figure 4:
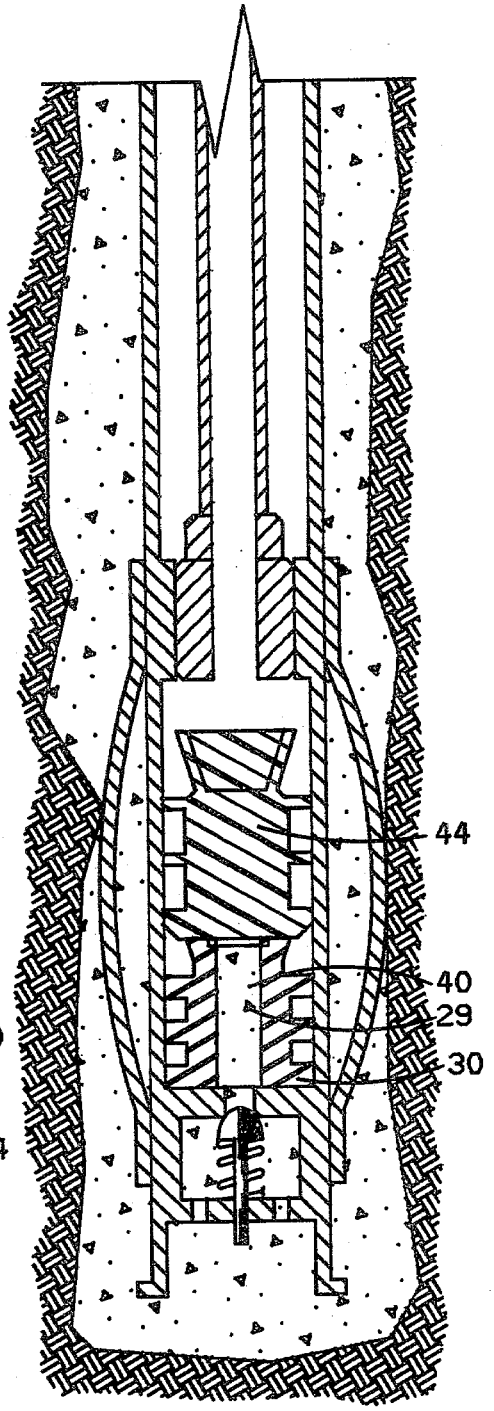
FIG. 4 is similar to FIG. 1 except that it shows the tool having cement circulated therethrough and the bottom plug resting on the float collar.

When the correct amount of cement has been placed into tubing string 14 to fill the annular space 16 to a predetermined level, a top plug 42 is inserted into the tubing 14. A driving fluid such as water then forces the top plug 44 and the cement slurry 29 beneath it downwardly until all the cement above the bottom plug 30 is displaced into the annular space 16. Upon reaching the larger diameter of casing 12, top plug 44 expands in a similar manner as bottom plug 30. As illustrated in FIG. 4, the top plug 42 then comes to rest on bottom plug 30. This closes off passage 40 in the bottom plug 30 and the pressure of the fluid being pumped into the tubing increases until the operator discontinues pumping the fluid. Preferably, a drilling string is used for tubing string 14.

J-slot 22, reciprocating/turning tool 18 and lug 20 can be made of high strength alloy steel so that collectively they can handle loads equal to or greater than the stress strength of the casing 12 or the tubing string 14.

The bottom plug 30 and the top plug 42 should be made of a material which will accommodate considerable variations in diameter, such as that found between the diameter of the tubing string 14 and the diameter of the casing 12. Preferably, the material of construction is polyurethane, which has been constructed in a braided manner.

While the above invention has been described in detail, various modifications can be made therefrom without departing from the spirit or the scope of the invention.

I claim:

1. A method for setting a casing in a wellbore comprising:

(a) suspending said casing in said wellbore, (b) suspending a tubing string in said casing (c) attaching the lower end of said tubing to the lower portion of said casing; and (d) oscillating and reciprocating said tubing while placing cement in at least a part of the annulus between the lower portion of said casing and the wall of said wellbore.

2. The method of claim 1 wherein additionally comprises step (e) which follows step (d), step (e) comprising discontinuing oscillation and reciprocation of said tubing prior to the setting of said cement.

3. The method of claim 1 wherein said cement is placed in said annulus by pumping said cement down the interior of said tubing.

4. The method of claim 1 additionally comprises maintaining the upper portion of said casing in an essentially fixed position.

* * * * *

UNITED STATES PATENT OFFICE
CERTIFICATE OF CORRECTION

PATENT NO. : 4,312,405

DATED : January 26, 1982

INVENTOR(S) : L. B. Wilder

It is certified that error appears in the above-identified patent and that said Letters Patent are hereby corrected as shown below:

Column 2, line 63, "16" should read --14--.

Signed and Sealed this

*Seventh* Day of *June 1983*

[SEAL]

*Attest:*

DONALD J. QUIGG

*Attesting Officer*

*Acting Commissioner of Patents and Trademarks*